US007044417B2

(12) United States Patent
Angold et al.

(10) Patent No.: US 7,044,417 B2
(45) Date of Patent: May 16, 2006

(54) HIGH SPEED TRANSFER TAKEUP

(75) Inventors: Russ Angold, San Rafael, CA (US); Jon Burns, Richmond, CA (US); Brian Lynch, San Francisco, CA (US); Nathan Harding, San Francisco, CA (US); Chris Van Wert, San Francisco, CA (US); Yu-Han Chen, Albany, CA (US)

(73) Assignee: Berkeley Process Control, Inc., Richmond, CA (US)

( * ) Notice: Subject to any disclaimer, the term of this patent is extended or adjusted under 35 U.S.C. 154(b) by 0 days.

(21) Appl. No.: 10/349,145

(22) Filed: Jan. 21, 2003

(65) Prior Publication Data

US 2003/0173448 A1 Sep. 18, 2003

Related U.S. Application Data

(60) Provisional application No. 60/350,592, filed on Jan. 18, 2002.

(51) Int. Cl.
*B65H 54/28* (2006.01)
*B65H 67/48* (2006.01)

(52) U.S. Cl. ..... 242/474.4; 242/476.1; 242/526.2; 242/125.1; 83/651.1

(58) Field of Classification Search ..... 242/474.4, 242/920, 476.1, 125.1, 526.2, 532.3; 83/651.1, 83/652

See application file for complete search history.

(56) References Cited

U.S. PATENT DOCUMENTS

| | | | | |
|---|---|---|---|---|
| 3,420,459 A | | 1/1969 | Peters | 242/25 |
| 3,677,492 A | | 7/1972 | Ueda et al. | 242/164 |
| 3,701,491 A | * | 10/1972 | Brown | 242/474.5 |
| 3,806,052 A | | 4/1974 | Maillefer | 242/25 |
| 4,223,848 A | | 9/1980 | Brokke et al. | 242/25 A |
| 4,477,033 A | | 10/1984 | Kotzur et al. | 242/18 A |
| 4,798,346 A | | 1/1989 | Myers et al. | 242/18 A |
| 4,848,687 A | | 7/1989 | Myers et al. | 242/18 A |
| 5,472,128 A | * | 12/1995 | Nagayama et al. | 226/7 |
| 5,803,394 A | | 9/1998 | Kotzur et al. | 243/483.8 |
| 6,273,168 B1 | | 8/2001 | Kawamura et al. | 156/517 |
| 6,425,545 B1 | * | 7/2002 | Adcock et al. | 242/474.8 |

FOREIGN PATENT DOCUMENTS

EP 0 561 063 A1 9/1993

* cited by examiner

*Primary Examiner*—Kathy Matecki
*Assistant Examiner*—Evan Langdon
(74) *Attorney, Agent, or Firm*—David H. Jaffer; Pillsbury Winthrop Shaw Pittman LLP

(57) ABSTRACT

An apparatus for transferring material winding between spools. The apparatus includes spindels for positioning first and second spools in a co-planar arrangement with parallel axes of rotation. With the material initially secured to the base of a first spool with tape, a winding mechanism is energized to turn the spools. When the first spool is filled, a first sheave directs the incoming material to the second spool which is rotated at the rate of material supply. A tape applicator is then directed to apply a section of tape over the material, pressing it against the base of the second spool. A small wire is included on the base of the tape being applied. The applicator force on the wire against the material is designed to be sufficient to sever the material, separating the material on the first spool from the material being wound on the second.

16 Claims, 6 Drawing Sheets

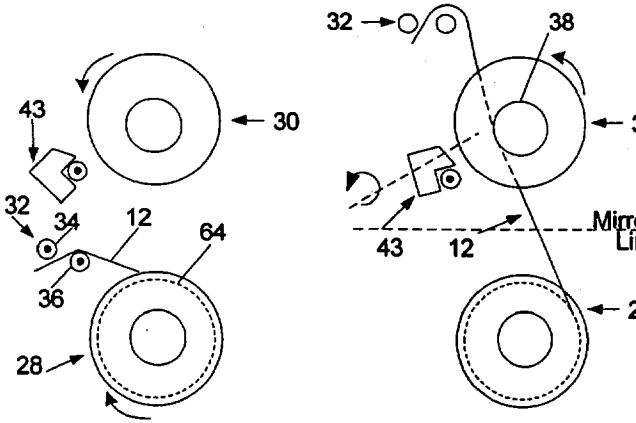
FIG. 2a
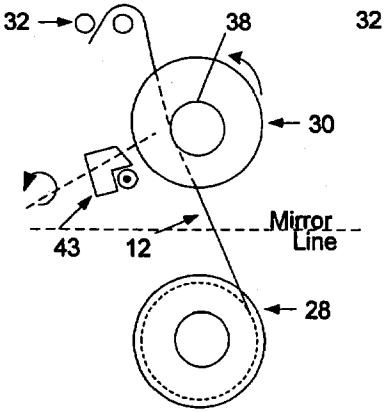
FIG. 2b
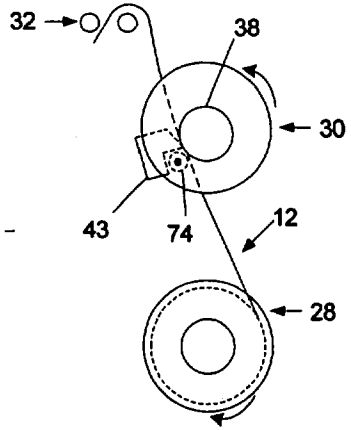
FIG. 2c
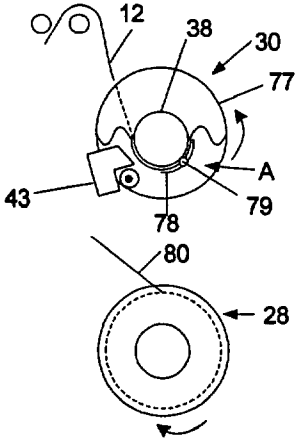
FIG. 2d
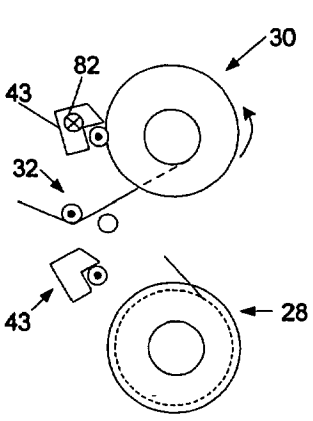
FIG. 2e
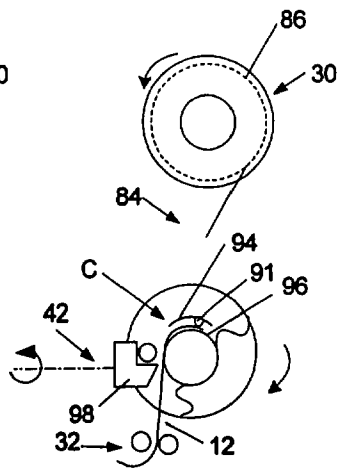
FIG. 2f
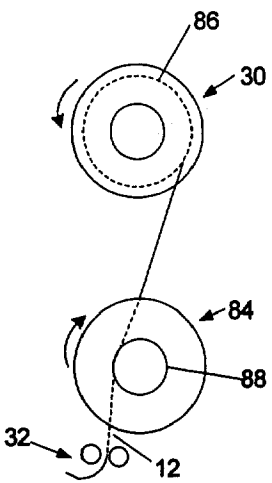
FIG. 2g
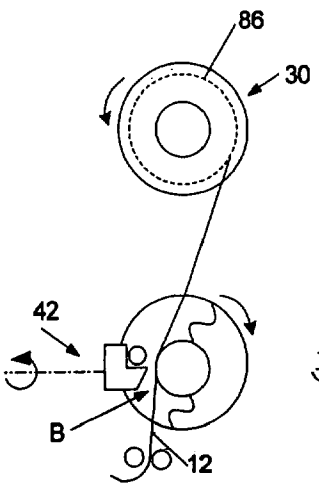
FIG. 2h
FIG. 2i
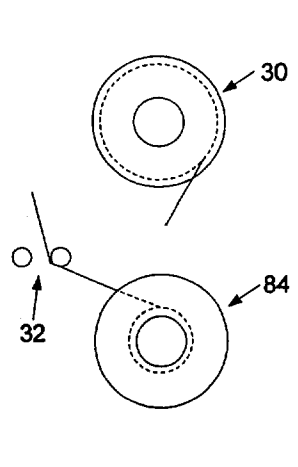
FIG. 2j

HIGH SPEED TRANSFER TAKEUP

This application claims priority from U.S. Provisional Patent Application Ser. No. 60/350,592 filed on Jan. 18, 2002.

BACKGROUND OF THE INVENTION

1. Field of the Invention

The present invention relates generally to methods and apparatus for continuous winding of material at high speeds, and more particularly to an apparatus for transfer of material winding between spools wherein the spools are positioned in a co-planar configuration providing for material transfer to be accomplishing without crossing over a spool flange.

2. Description of the Prior Art

In order to maximize the economy of manufacture of elongated, spool wound material, it is necessary to configure the manufacturing process to allow continuous operation while transferring winding from a filled spool to an empty one. Shutting down the winding process to transfer between spools is time consuming and in some cases detrimental to product quality. For example, in the case of optical fiber production, the fiber is pulled from a molten billet of quartz by an apparatus called a draw machine. Disrupting or stopping the process is costly, since the drawing operation, once disturbed, must be started slowly and ramped back up to production speed. In addition to the lost time, material is wasted because the fiber made during the speed-increase ramp is largely thrown away. Because of this inefficiency, systems have been designed to accomplish a "flying transfer" wherein the fiber is wound onto an empty spool without stopping the drawing operation. U.S. Pat. No. 4,798,346 by Meyers et al. describes one such system wherein each spool has a mechanism called a collector. Meyers refers to the collector as a storage and clamping assembly, item 47 in reference to FIG. 7 of Meyers. The collector is embodied as two disk-like structures about the same diameter as the spool upon which the fiber is being wound. The collector disks are positioned adjacent a flange of each spool and rotate on the same axis as the flange and at the same velocity. Two spools are positioned in axial alignment, with their collector apparatus facing each other. During the winding process, both spools and collection assemblies are rotating at the same velocity. When the winding of fiber on one spool is complete, the distributor leads the fiber over the flange of the first spool and onto the collector assembly of the second spool. At this time the collector disks of the empty spool are open/spaced apart. A portion of the fiber is wound on an array of pins between the disks, whereupon the disks are clamped, securing the fiber. The distributor then guides the fiber over onto the empty spool and winding continues. A cutter is then extended to sever the fiber between the two spools, freeing the full spool for removal and replacement with an empty spool.

A variation of the collector system has the two spools radially offset. In this case, when the distributor moves the fiber onto the collector of the new spool, the fiber is clamped and quickly breaks due to the stretching action caused by relative motion of the collectors of the full spool and empty spool. A cutter bar can also be used in the system to sever the fiber between the spools. Once the fiber is broken, the transfer proceeds in the same manner as with axially offset systems.

Another variation of the collector system employs a snagger button mounted into the rotating portion of the spindel turning the spool. Upon transfer from a full spool to an empty spool, the distributor leads the fiber over the spool flange to the snagger button corresponding to the empty spool. On the next rotation of the spool, the snagger button snags the fiber and begins wrapping it around the empty spool. A cutter bar is extended and the fiber between the spools is cut.

A disadvantage of the above described methods of transferring fiber between spools is that the speed of the spools during transfer is not constant. The speed varies as the fiber is moved over the spool flanges and onto the base of the empty spool. In some designs, slots are cut in the flange for passing of the fiber in order to reduce the disturbance in fiber speed when the distributor leads the fiber over the flange. The slot, however, weakens the spool and increases its tendency to flex and distort, damaging the quality of the wound package. Both the collector mechanism and the snagger mechanism introduce large disturbances in the speed of the fiber as the fiber is suddenly grabbed. These sudden disturbances in the speed of the fiber greatly increase the tendency of the fiber to break, resulting in a costly shutdown of the fiber drawing machine. Another problem with both the collector and snagger mechanisms is that they occasionally fail to successfully transfer the fiber, again causing a costly shutdown of the fiber drawing machine. Furthermore, this tendency to miss/fail increases as the speed of the fiber increases. Given the unrelenting quest for higher drawing speeds, this tendency is clearly at odds with reliable high-speed machines.

SUMMARY

It is therefore an object of the present invention to provide a more reliable method and apparatus for transferring winding of material from one spool to another while maintaining a continuous winding operation.

It is a further object of the present invention to provide a method and apparatus for transferring winding of material between spools that does not require passing, the material over a spool flange.

It is another object of the present invention to provide a method and apparatus providing a flying (during winding) transfer of winding material between two spools that does not substantially disturb the material.

It is an object of the present invention to provide a method and apparatus for transferring winding between two spools that adheres the material to the base of the empty spool and severs the material in a single operation.

It is a still further object of the present invention to provide a method and apparatus that does not cause or require the spools to change speed during transferring of winding between spools.

Briefly, a preferred embodiment of the present invention includes an apparatus for transferring material winding between spools. The apparatus includes spindels for positioning first and second spools in a co-planar arrangement with parallel axes of rotation. With the material initially secured to the base of a first spool with tape such as adhesive tape or a similar product, a winding mechanism is energized to turn the spools. When the first spool is filled, a first sheave (grooved wheel/pulley) directs the incoming material to the second spool which is rotated at the rate of material supply. A tape applicator is then directed to apply a section of tape over the material, pressing it against the base of the second spool. A small wire is included on the base of the tape being applied. The applicator force on the wire against the material is designed to be sufficient to sever the material, separating the material on the first spool from the material being wound on the second.

An advantage of the present invention is that it avoids the need to move the material across variable diameters that cause speed changes.

A further advantage of the present invention is that it does not require moving the material over a spool flange and into a collector mechanism.

IN THE DRAWING

FIG. 1 is an illustration for description of a system incorporating a preferred embodiment of the present invention;

FIGS. 2(*a*) through 2(*j*) illustrate actuator apparatus for positioning the material placement rollers and the tape and cutter apparatus; and FIG. 3 shows a sequence of positions of the material positioning apparatus and tape apparatus in the transfer process;

DETAILED DESCRIPTION OF THE PREFERRED EMBODIMENT

Figure 1:
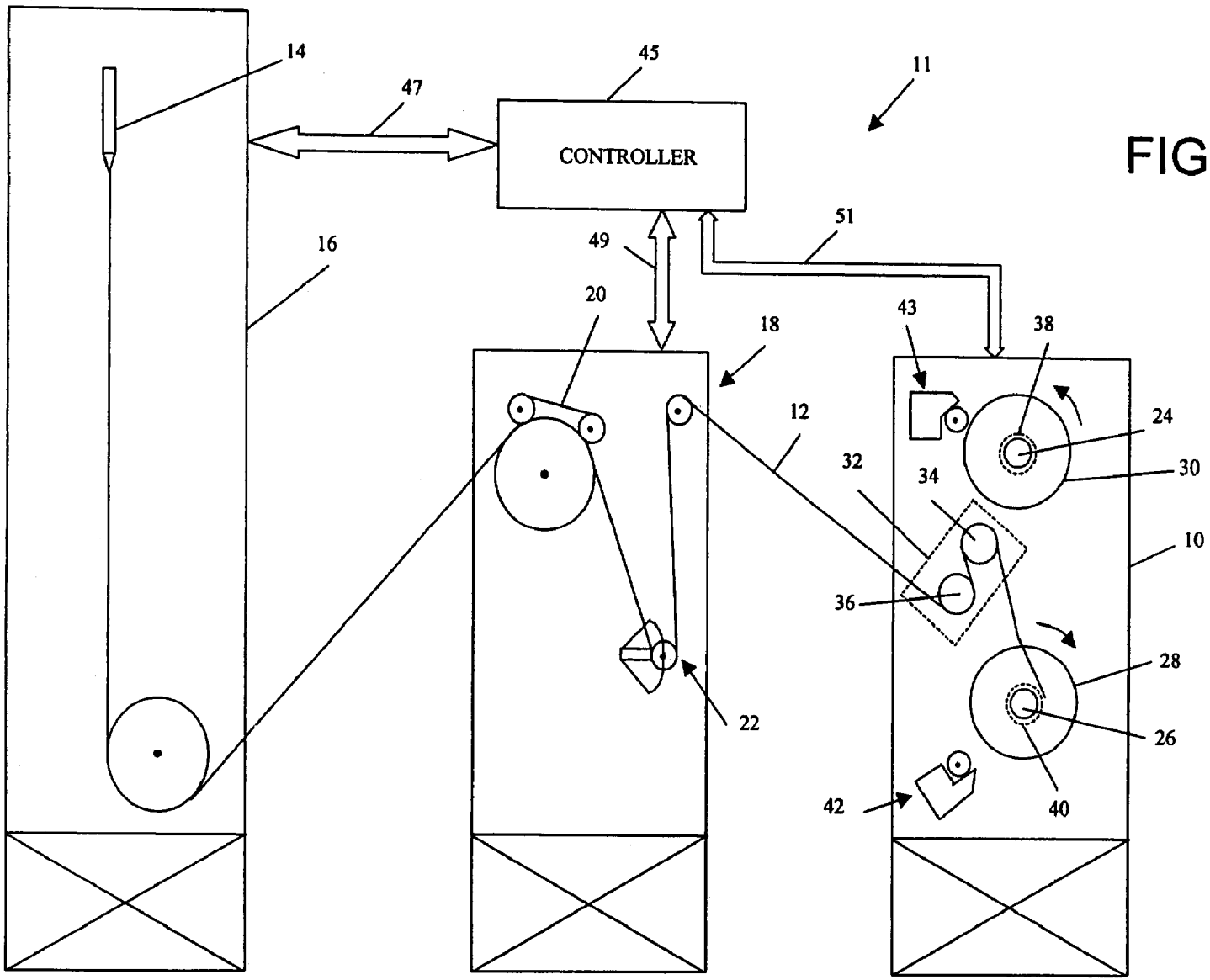

Referring now to FIG. 1 of the drawing, there is illustrated a system 11 including a preferred embodiment of the high speed take-up apparatus 10 of the present invention, shown with material 12 being fed into the apparatus 10. The material 12 is drawn from a heated preform 14 in a draw tower 16. A material buffer 18 provides guidance by a capstan apparatus 20, and tension accommodation with a dancer mechanism 22. The take-up apparatus 10 includes spool drive shafts 24 and 26 for turning first and second spools 28 and 30 respectively. FIG. 1 shows the apparatus 10 in the process of winding material 12 onto spool 28. When the spool 28 is nearly filled, a material positioning apparatus 32, including sheaves 34 and 36, moves to position the material 12 against the base 38 of spool 30. Similarly, when the material 12 is attached to and winding on spool 30 and it is necessary to transfer to spool 28, the apparatus 32 moves the position of the incoming material 12 adjacent base 40 of spool 28. The movement of positioning apparatus 32 will be fully illustrated in reference to the following figures of the drawing. The take-up apparatus 10 includes one or two tape and cutter apparatus, illustrated symbolically as items 42 and 43 for attaching the material 12 to the base of the adjacent spool. In the preferred embodiment, a single tape and cutter apparatus 43 is used that is moved from the position as indicated in FIG. 1, to the position indicated by item number 42 through use of an apparatus that moves the tape and cutter apparatus from one position to the other and rotates it 180° as shown in FIG. 1. FIG. 1 also shows a controller 45 interconnected through bus lines 47, 49 and 51 to apparatus 16, 18 and 10 for controlling the various operations as required.

In operation, the material 12 is drawn from the preform 14, and is typically guided by an apparatus such as buffer 18 to positioning apparatus 32. The material is initially attached to the base of a spool, for example, base 40 of spool 28. The process could also begin by attachment and winding on spool 30. The drawing process and winding on spool 28 then proceeds at a uniform rate until spool 28 is nearly full, at which point, the positioning apparatus 32 positions the material 12 so as to pass in proximity with the base 38 of empty spool 30. A tape and cutter device such as 43 then moves to the spool base 38, whereupon a length of tape with a wire preferably attached is ejected and pressed against the material 12 and base 38. The tape secures the material to the base. The length of wire adhered to the tape lies substantially perpendicular to the direction of the material 12 movement, and the pressing of the wire against the material 12 fractures or otherwise severs it. At this point, the spool 30 is spinning and winding the material. The spool 28 is stopped, removed, and replaced with an empty spool. When spool 30 is nearly full, the transfer process is repeated. The positioning apparatus 32 moves the material adjacent the base 40. The applicator-cutter as indicated by item number 42 as described above, moves into contact, and the tape is secured and the film severed from spool 30. The apparatus of FIG. 1 is preferably designed/optimized for winding optical fiber. The present invention also includes the apparatus of FIG. 1 designed for winding any of a variety of materials, and these will be apparent to those skilled in the art.

The sequence of operations is more clearly described in reference to the illustrations of FIGS. 2*a*–*j*.

FIG. 2*a* shows spool 30 as empty, and spool 28 as full, or in practice nearly full, since some time must be allowed for the transfer operation, during which the material will continually be wound on spool 28 until the material 12 is cut. The material positioning apparatus 32 is indicated by sheaves (grooved wheel/pulley) 34 and 36, and the tape and cutter apparatus as items 42 and 43. The sheaves 34 and 36 are positioned preferably approximately equidistant from the two spools 30 and 28 during the majority of the time while winding on a spool, which is a position providing a more direct path for the fiber in reaching the spool than in the more extreme positions required during the transfer of fiber winding from one spool to another. This intermediate point is indicated in FIG. 2*b* by the dashed line labeled "mirror line". The mechanism/apparatus required for moving the sheaves 34, 36 and tape and cutter apparatus 42 and 43, and other details are not shown in order to simplify the illustration. The mechanical devices required will be described in subsequent figures of the drawing to the extent necessary for someone skilled in the art to reproduce the invention.

FIG. 2*a* shows spool 28 nearly full of winding 64 of material 12. The system 11 includes apparatus (not shown) for inputting data to, the controller 45 sufficient,to allow the controller, programmed accordingly to calculate the speed of the fiber 12. The controller also is programmed to calculate the amount of fiber wound on a spool, and when a spool is nearly full of material 12, the controller 45 directs movement of the positioning apparatus 32 to a position as shown in FIG. 2*b* wherein the material 12 is in contact with the base of spool 30. The controller, being programmed to know the speed of material 12 delivery, is also programmed to direct the rotational speed of the base 38 of spool 30 to substantially equal the speed of the material 12 so as to avoid material speed change during the transfer. In practice, a slight difference in the speeds may be desirable in order to maintain tension between the spools when cutter apparatus 43 is pushing material 12 against base 38. The controller, for example can be programmed with the diameter of winding 64 when the detector 66 signal is received by the controller, and also with the speed of rotation of spool 28. From this information and the diameter of spool 30 base 38, the controller can be programmed to set the necessary speed of rotation of spool 30. The controller also directs apparatus to move the tape and cutter apparatus 43 towards the spool 30 base 38. FIG. 2*c* shows the tape and cutter 43 with the tape roller 74 pressing against the material 12 and base 38 of the spool 30. The situation as shown in FIG. 2*c* can be attained in either of two procedures as follows. The tape and cutter apparatus 43 can first be moved a distance from the eventual point of contact between the apparatus 43 and the fiber 12, for example as shown in 2*b*. When the positioning apparatus 32, moving parallel with the axis of rotation of the spools 30 and 28, brings the fiber into the position at which transfer is to take place, the tape and cutter apparatus 43 is moved rapidly into the cutting and taping position as shown in FIG. 2*c*, with the roller 74 pressing the fiber 12 against the spool 38. A more preferred method of operation, however, is as follows. The wheel 74 of the tape and cutter apparatus 43 is moved into contact with the spool 38 prior to arrival of the fiber 12. The edge of the roller 74 of the apparatus 43 is constructed with a taper/bevel so that when the fiber is pressed against the roller and spool 38 by the apparatus 32 running parallel with the axis of rotation of the spool 38 and apparatus 43 roller 74, the fiber moves between the roller 74 and spool 38. At this point, the apparatus 43 then proceeds with the cutting and taping operation, as will now be more fully described. At this point in time the tape and cutter 43 is directed by the controller to dispense a section of tape with a wire attached. The roller 74 then presses the tape and wire against the material 12 and base 38. The pressure of the wire fractures/severs the material 12 and the tape secures the material to the base 38. FIG. 2*d* shows the result in a view with the obscuring flange 77 partially cut away as indicated by the letter "A", for more clearly showing the apparatus 43 and tape 78 and wire 79. The tape 78 is adhering the material 12 to the base 38 and the material 12 is therefore now winding on the spool 30. The severed material 12 portion 80 is now free of the winding process and the spool 28 can be stopped and unloaded, as shown in FIG. 2*e*. The positioning apparatus 32 is shown in FIG. 2*e* moved to the more neutral position, minimizing the stress on the material 12 as the winding of spool 30 continues. The applicator/tape and cutter 43 is shown in solid lines moved out of the way of positioning apparatus 32. This can be accomplished in various ways, including movement to the position as illustrated. In a preferred embodiment this is accomplished by moving the applicator 43 in a direction parallel with the axis of rotation of the spools, taking the apparatus 43 out of the plane of movement of the material 12. This is indicated by the arrow end 82 of the apparatus 43 shown in FIG. 2*e*.

The full spool 28 is replaced with an empty spool 84, as shown in FIG. 2*f*. As shown in FIG. 2*g*, when the windings 86 reach a predetermined level, the controller directs the positioning apparatus 32 to move the material 12 into contact with the base 88 of spool 84, which has been brought to the required speed to match the speed of the material. The controller then moves a second applicator 42, or applicator 43 as explained above in reference to FIG. 1, into contact with the material 12, and a tape and wire is dispensed, as illustrated in FIG. 2*h*, showing the fiber 12 and apparatus 42 in solid lines due to cutaway of the spool flange in area B. As shown in FIG. 2*i*, the material 12 is fractured/cut by wire 91, and a tape section 94 adheres the material 12 to the base 96 of spool 84. The spool flange is cut away for clarity of illustration in area C. The applicator 42 is then moved out of the path of the material 12 as indicated by arrow 98 and the positioning apparatus 32 moves again to a more neutral position as shown in FIG. 2*j*. The full spool 30 can then be removed and replaced with an empty spool. The process of FIGS. 2*a–j* then can be repeated until all the material 12 has been wound on spools.

Figure 3:
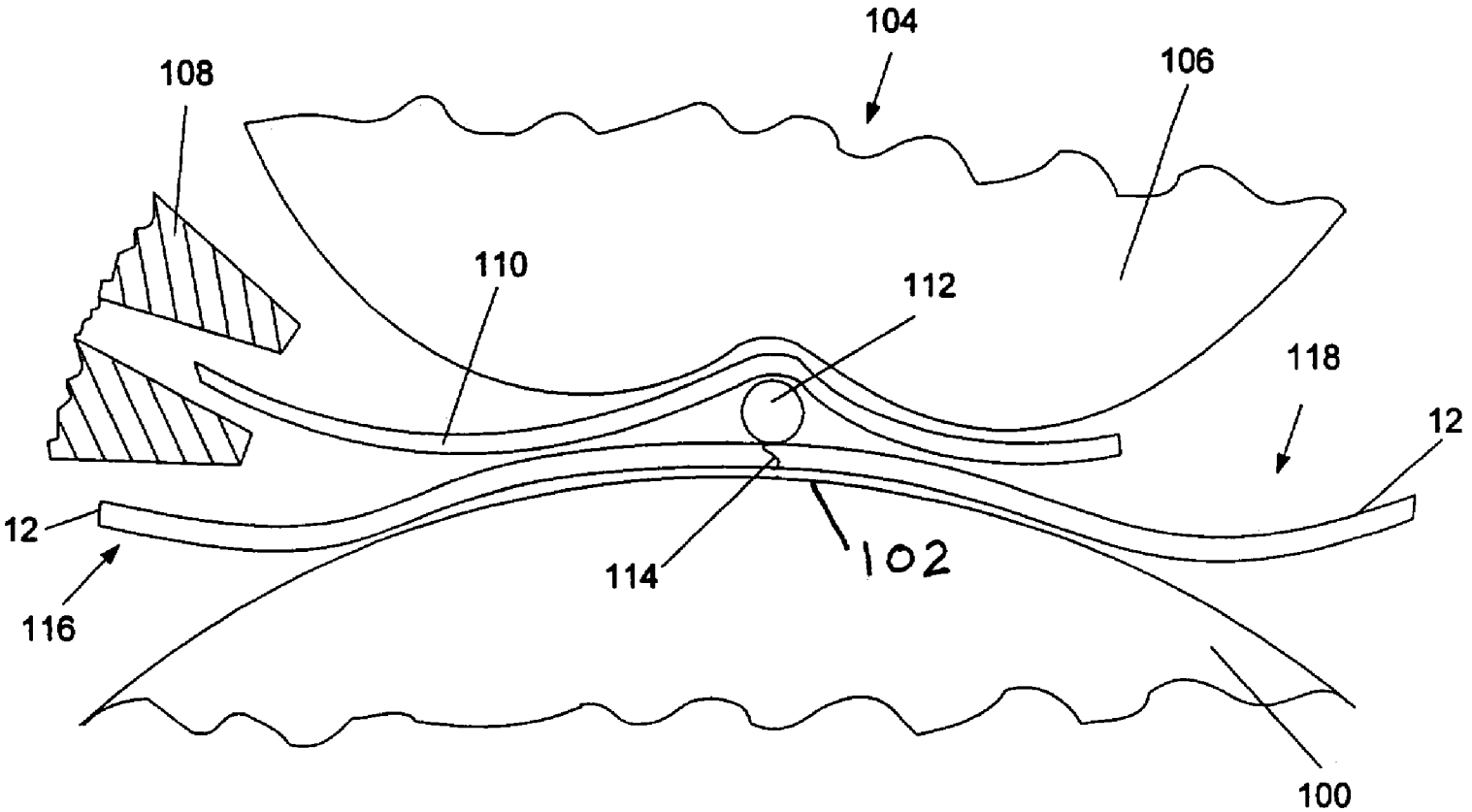

FIG. 3 is an enlargened partial view for illustration of the application of the tape and cutter material. Material 12 is shown in contact with the base 102 of a spool 100. An applicator 104, similar to applicators 42 and 43 of FIGS. 1 and 2, has a roller 106 and a tape dispenser 108. When the roller 106 contacts the material 12, the dispenser 108 is directed to eject a length of tape 110, which has attached a laterally oriented length of wire 112, lying perpendicular to the direction of movement and length of the material 12. The dispenser tape ejection mechanism is not shown, but will be understood by those skilled in the art. The dispenser 108 includes apparatus for ejecting a particular length of tape, and can include a tape cutting apparatus for that purpose. The tape is drawn by the roller 106 and friction with the moving material 12 and base 102. The pressure,and flexibility of the roller 106 material is such that the roller forms around the wire and material so as to pressure and adhere the tape 110 against the base 102. The pressure of the wire against the material 12 causes the material 12 to fracture, as indicated by line 114. The incoming material 12 at position 116 is then adhered to and wound on the base 102. The severed material 12 at 118 is then free to be removed along with the spool to which it is attached. Although the apparatus 42 and 43 as illustrated in FIG. 3 uses a wire to sever the material 12, this is a preferred embodiment that is particularly applicable when the material 12 is an optic fiber. The present invention also includes the apparatus 42 and/or 43 designed to cut the material 12 by other methods that will be apparent to those skilled in the art upon reading the above description. For example, a synchronized cutter blade (not shown) can be used for cutting a variety of types of material 12.

Figure 4:
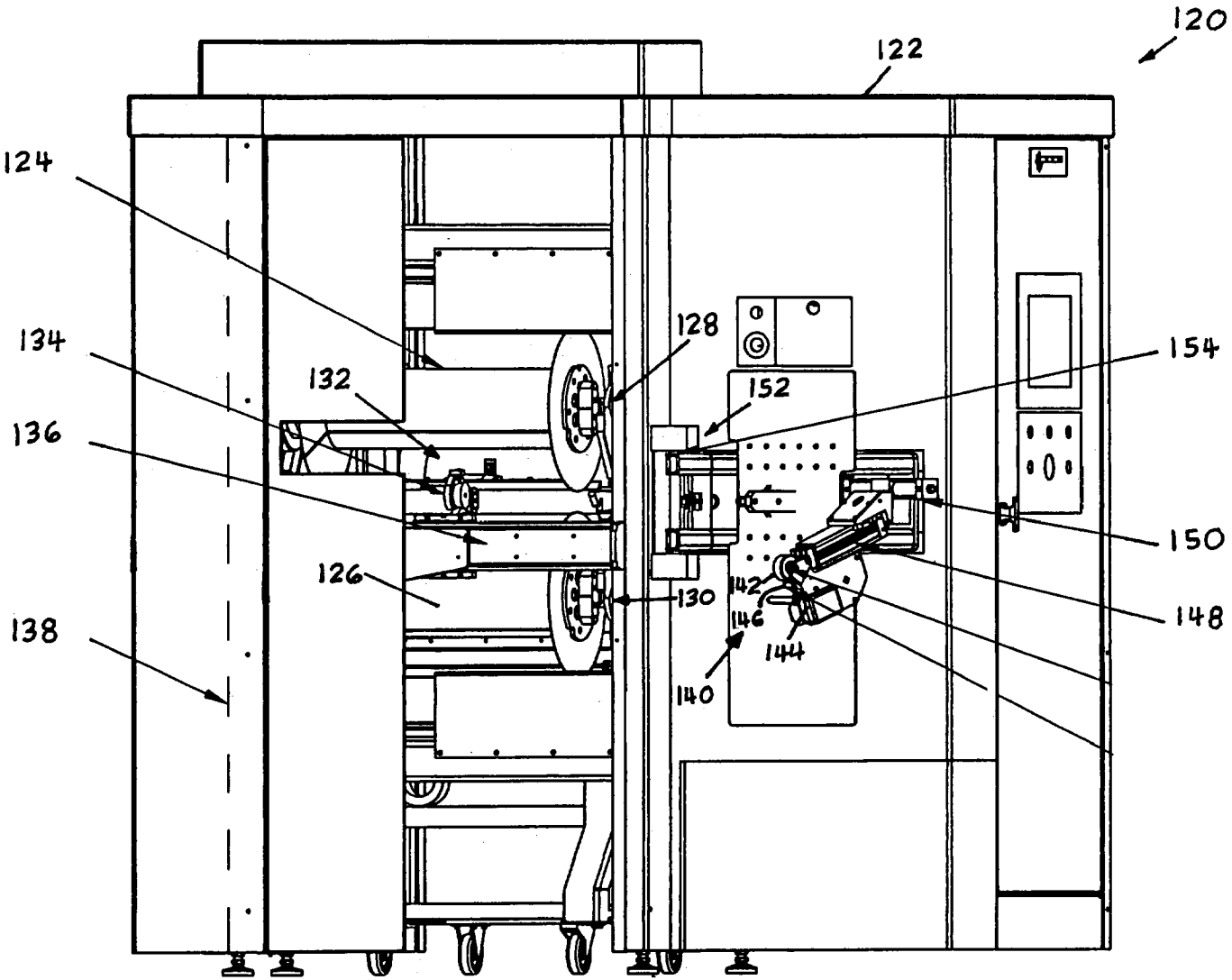
FIG. 4 is a planar view of a sketch of a production apparatus for performing the operations of the high speed take-up apparatus described in reference to FIGS. 1–3.

FIG. 4 is a planar view of a sketch of a production apparatus 120 for performing the operations of the high speed take-up apparatus 10 described in reference to FIGS. 1–3. A housing 122 is shown with first and second spools 124 and 126 installed and held in place and rotated as required by apparatus partially shown at 128 and 130. A distributor 132 is shown for performing functions as described in reference to the positioning apparatus 32 of FIG. 1. A sheave 134 is visible in FIG. 4, as well as a horizontal gantry 136 for moving the sheave(s) 134 horizontally. A vertical gantry for moving the sheaves vertically is also included, but is hidden behind the housing 122 and is indicated only as line 138. A tape and cutter apparatus 140 is shown including a roller 142 (corresponding to roller 74 of FIG. 2*c*) and tape dispenser 144 with a tape feed point 146. A linear thruster 148 moves the tape dispenser 144 and roller 142 forward and backward as required to position the dispenser 144 adjacent a spool base as described above. The apparatus 140 includes a 180° rotation cylinder apparatus 150 for rotating the tape dispenser 144 and roller 142 as required to be positioned as described in reference to FIG. 1 and FIGS. 2*h* and 2*i*. The apparatus 140 is rotated by a pivot apparatus 152 about pivot point 154 in order to move the apparatus 140 out of the operating area of the distributor 132 apparatus as required.

Figure 5:
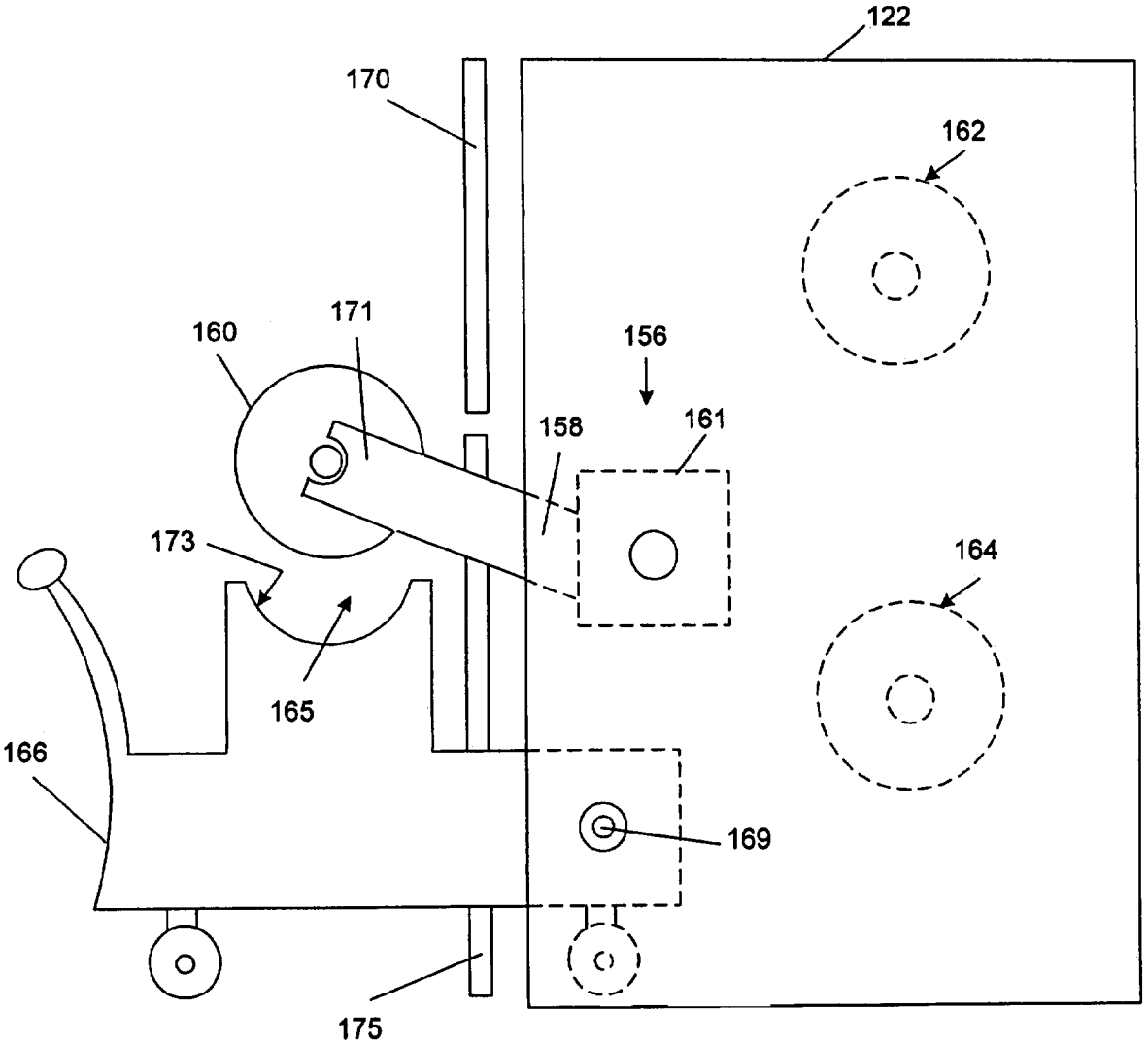
FIG. 5 illustrates a spool loading and unloading apparatus.

The apparatus 120 of FIG. 4 also includes spool loading and unloading facility, as indicated by loading apparatus 156 in FIG. 5. The apparatus 156 has two arms 158, with each arm for gripping one of two ends of a spool. Due to the planar view of FIG. 5, only one arm is visible as the other arm on the other side of spool 160 is behind arm 158. The apparatus has an arm drive 161 that is positioned equidistant from the spool positions 162 and 164 indicated by the dashed circular lines. The drive 161 is also the same distance to position 165 of a semi-circular receptor 173 on cart 166 when the cart is in a pre-determined aligned/secured position to the housing 122. The, alignment of the cart to the housing 122 is symbolically indicated by a pin 169. FIG. 5 also symbolically shows two shrouds 170 and 175 for shielding the spools during the process of fiber winding. For loading and unloading, the shroud covering the accessed spool is retracted. Details concerning the construction and operation of shrouds will be apparent to those skilled in the art upon reading the present disclosure.

In operation, after the system transfers winding to an empty spool, rotation of the full spool is stopped and a notice is given that a spool is ready to be replaced. The corresponding shroud over the full spool is retracted, and an operator installs the cart 166, aligning/securing it in position. The controller then directs the loading and unloading apparatus 156 to grasp the spool to be unloaded. This is done with extendable fingers on the arm ends 171. If the full spool is at position 162, for example, the arm 158 rotates to that position and grasps the spool. Head and tail stock for rotating the spool are disengaged, and the arm delivers the spool to the cart spool receptacle 173 at 165. A reverse operation applies for installing an empty spool at position 162. The operation is similar for loading and unloading a spool to and from location 164.

Figure 6:
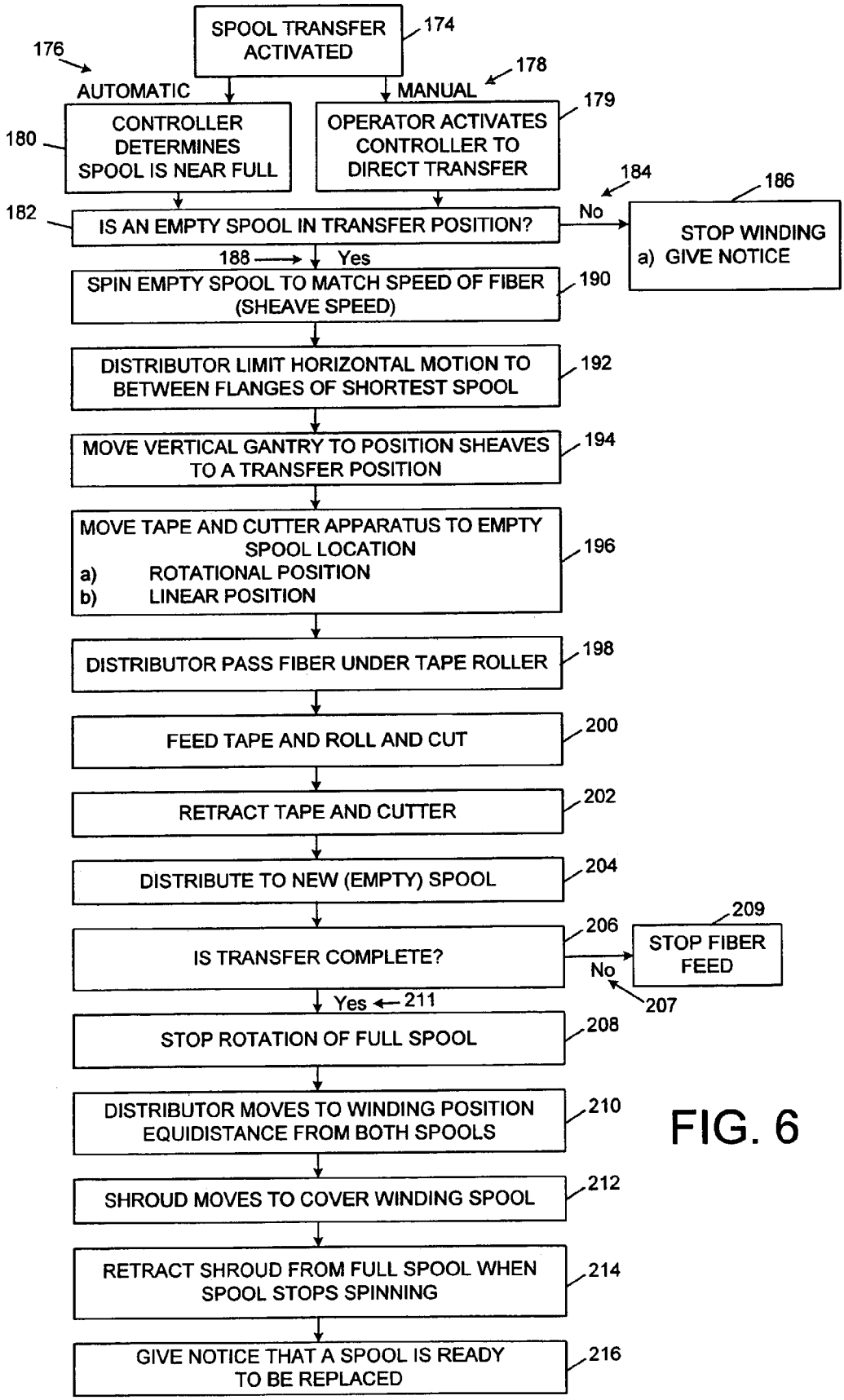
FIG. 6 is a flow chart for illustration of the operation of transfer of winding from one spool to another spool.

The operation of the transfer of winding from one spool to another will now be described in reference to the flow chart of FIG. 6. Transfer begins with some form of activation (block 174), which can be accomplished automatically according to pre-determined criteria 176, or an operator can manually initiate spool transfer at any time 178. Block 179 indicates the manual procedure wherein an operator activates the controller, for example through a key pad, to notify the controller to direct a spool transfer. In automatic mode (block 180), the controller has been pre-programmed to sense and respond to a pre-determined amount of fiber wound on a spool, and automatically direct the transfer of winding on one spool to winding on another spool. Preferably the pre-determined quantity is a prescribed length of fiber, determined by the controller from the speed and dimensions of the capstan 20. The controller can alternatively determine the amount of fiber by other methods that will be understood by those skilled in the art, and these are also included in the spirit of the present invention. For example, sensors can be installed to detect the level of fiber on a spool, and the signal provided by the sensors can indicate to the controller that a spool transfer is to be activated. These sensors, for example can include a light emitter and detector.

The system 11 then checks to assure that an empty spool is in the transfer position (block 182). In alternative embodiment, if an empty spool is not in position 184, the controller 45 directs the system 11 to stop winding fiber 186, and give notice that a transfer spool is required (block 186). With an empty spool in position 188, the controller 45 directs the system 11 to spin the empty spool through a speed matching the speed of the fiber being wound (block 190). The construction of sensors, etc. required to determine fiber speed and speed of spool rotation will be understood by those skilled in the art, and therefore need not be described in the present disclosure in order to reproduce the present invention. The distributor/positioning apparatus 32 (FIG.1) is then directed by the controller to limit horizontal motion of the sheaves feeding the fiber being wound on a spool, to extremities between the flanges of the shortest spool of the two spools involved (block 192). The controller then directs the positioning apparatus 32 so as to move the vertical gantry to position the sheaves feeding the fiber, to a position placing the fiber adjacent to the base of the empty spool (block 194).

The controller 45 then directs the tape and cutter apparatus to move to the empty spool location (block 196). This operation involves rotating of the apparatus 140 (FIG.4) around the pivot point 154, rotation of the tape and cutter to the correct orientation by the rotational apparatus 150, and moving the tape and cutter apparatus towards the spool base by the thruster 148. The distributor horizontal gantry then passes the fiber under the tape roller (block 198), and coincident with the positioning of the fiber, the thruster 148 presses the roller against the fiber, a tape section is dispensed by the tape apparatus and the attached wire cuts/breaks the fiber (block 200). The tape at this point secures the fiber being fed by the system 11, to the base of the empty spool. The tape and cutter is then retracted from the area of the empty spool (block 202). The system 11 then proceeds with winding the fiber on the new/"empty" spool (block 204). The system 11 then checks to determine if the transfer of fiber is complete (block 206).

If transfer has not taken place 207 i.e. if the operations as described in reference to blocks 200–204 have not occurred and the fiber is still being wound on the full spool, or if the fiber is not connected to either spool, the fiber feed is stopped (block 209). If the fiber has successfully been transferred to the empty spool (211), the controller then stops the rotation of the full spool (block 208), and directs the distributor to move the sheaves to the normal winding position approximately equidistant from the two spools (block 210). As noted in block 212, a shroud is moved to cover the spool that is being wound. Similarly, a shroud is retracted from covering the full spool that at this point is not rotating, in order to allow removal of the full spool and replacement with an empty spool (block 214). The controller then preferably gives a notice that a spool is ready to be replaced (block 216).

The operation of checking to determine if a transfer of winding to an empty spool is complete, indicated by block 206 will now be described in more detail. The controller is programmed as described in reference to FIGS. 2*a*–2*j* to know which of the tape dispensers 42 or 43 has ejected tape or i.e. which of the spool positions referenced by drive shafts 24 or 26 has just had tape applied on an empty spool. The controller, as explained in reference to FIGS. 2*a*–2*j*, also knows when a spool upon which fiber is being wound reaches a "full" condition. The controller also has a separate control facility for each of the two spools. When the controller senses that a spool is "full", it automatically adjusts the speed of the spool to achieve a pre-determined dancer 22 test offset, for example +31 degrees, and this state (+31) is noted by the controller. If the controller senses that a label/tape has just been applied to a spool, the controller adjusts the spool drive so that the dancer 22 is at an opposite pre-determined test offset, such as −31°. The controller can therefore monitor the dancer position to know if transfer has taken place by first receiving indication of a full spool by noting a dancer position of +31°, and subsequently noting a new/changed dancer position of −31°. A position of +31° (full spool) being maintained indicates that a required transfer has not occurred, and if after a pre-determined time interval the detected dancer position does not change to −31°, the winding operation is stopped, as indicated by block 207. Also, if the fiber becomes disconnected from both spools, the dancer position will exceed +30° and the system is designed to detect such a position and respond by stopping the fiber feed system.

While a particular embodiment of the present invention has been shown and described, it will be obvious to those skilled in the art that changes and modifications may be made without departing from the spirit of the present invention and its other aspects, and therefore the appended claims accomplished within the scope also has changes and modifications as follow within the true spirit and scope of the present invention.

What is claimed is:

1. A high speed material transfer apparatus comprising:

an apparatus for transferring elongated material on the fly between spools during winding of said material including (a) a first spool drive apparatus for turning a spool in a first rotational direction;

(b) a second spool drive apparatus for turning a spool in a second rotational direction, and wherein said spool on said second drive is positioned substantially in a parallel relationship with a spool on said first drive;

(c) a material positioning apparatus for positioning a length of material being drawn toward and wound onto a spool on one of said first and second drives, said positioning including placing said length adjacent to a base of said spool on the other one of said first and second drives;

(d) a tape applicator apparatus for applying a length of tape to said material for adhering said material to said spool on said other one of said drives during winding of said material on said spool on said one of said first and second drives; and (e) a material severance apparatus for severing said material at a position between said spool on said one of said drives and said spool on said other one of said drives and thereby allowing said material to be wound on said spool on said other one of said drives and allowing said spool to be removed from said one of said drive apparatus, wherein said material severance apparatus includes apparatus for pressing a length of wire attached to said length of tape against said material.

2. An apparatus as recited in claim 1 wherein said material severance apparatus is a separate apparatus from said tape applicator apparatus.

3. An apparatus as recited in claim 1 wherein said material is fiber optic fiber.

4. An apparatus as recited in claim 1 further comprising controller apparatus for determining when to transfer winding between a spooi on said first drive apparatus and a spooi on said second drive apparatus.

5. An apparatus as recited in claim 4 further comprising spooi handling apparatus for loading and unloading a spool to and from said high speed material transfer apparatus.

6. An apparatus as recited in claim 5 wherein said controller apparatus automatically gives a notice when a spool is ready to be unloaded.

7. An apparatus as recited in claim 4 further comprising a shroud apparatus for covering a spool upon which said material is being wound.

8. An apparatus as recited in claim 7 wherein said controller apparatus directs said shroud to cover a spool upon which said material is being wound.

9. An apparatus as recited in claim 4 wherein said controller apparatus further includes apparatus for turning said second spool at a speed to substantially match a speed of said material being wound.

10. An apparatus as recited in claim 4 wherein said controller gives a notice if an empty spool is not loaded.

11. An apparatus as recited in claim 4 wherein said determining includes determining when a predetermined length of material has been wound on a spool.

12. A high speed material transfer apparatus comprising:

an apparatus for transferring elongated material on the fly between spools during winding of said material including (a) a first spool drive apparatus for turning a spooi in a first rotational direction;

(b) a second spool drive apparatus for turning a spool in a second rotational direction, and wherein said spool on said second drive is positioned substantially in a parallel relationship with a spool on said first drive;

(c) a material positioning apparatus for positioning a length of material being drawn toward and wound onto a spool on one of said first and second drives, said positioning including placing said length adjacent to a base of said spool on the other one of said first and second drives;

(d) a tape applicator apparatus for applying a length of tape to said material for adhering said material to said spool on said other one of said drives during winding of said material on said spool on said one of said first and second drives, wherein said tape applicator apparatus includes (i) a tape roller for pressuring said length of tape against said material and against a base of said spooi on said other of said drives;

(ii) a tape dispenser for ejecting said length of tape towards said tape roller; and wherein said length of tape has a wire attached, and wherein said roller is further for pressuring said wire against said material for severing said material, thereby providing a material severance apparatus for severing said material at a position between said spool on said one of said drives and said spool on said other one of said drives and thereby allowing said material to be wound on said spool on said other one of said drives and allowing said spool to be removed from said one of said drive apparatus.

13. A method of high speed material transfer comprising:

(a) first spool winding a material on a spool on one of first and second spindels, said one spindel rotating in a first rotational direction;

(b) positioning a length of said material adjacent a base of a spool on the other one of said spindels, said spindel turning in a second rotational direction and positioned parallel to said one of said spindels;

(c) applying a length of tape over said material adjacent said base of said spool on said other one of said spindels for adhering said material to said base of said spool on said other one of said spindels, said applying occurring while said spools are rotating, wherein said applying includes pressing said tape against said material and against said base with a roller; and (d) severing said material at a point between said spools, wherein said severing includes said roller compressing a wire against said material.

14. A method as recited in claim 13 wherein a circumferential speed of said spool on said other spindel is substantially equal to a speed of travel of said material when said length of material is adhered to said spool on said other spindel.

15. A method as recited in claim 13 further comprising:

(a) replacing said spool on said one of said spindels with an empty spool;

(b) second spool winding of said material of said spool on said other one of said spindels;

(c) positioning a length of material adjacent a base of said empty spool;

(d) applying a length of tape over said material adjacent said base of said empty spool for adhering said material to said base of said empty spool;

(e) severing said material at a point between said spool on said first spindel and said spool on said second spindel; and (f) replacing said spool on said other spindel with a spool that is empty.

16. A method as recited in claim 15 further comprising repeating the steps of claims 13 and 15 for achieving continuous winding of said material.

* * * * *